United States Patent [19]

Mellen

[11] 4,165,192

[45] Aug. 21, 1979

[54] ASPHALT SPREADING MACHINE

[76] Inventor: Craig R. Mellen, 4243 S. 9th East, Salt Lake City, Utah 84117

[21] Appl. No.: 644,976

[22] Filed: Dec. 29, 1975

[51] Int. Cl.[2] ..... A46B 11/00; A46B 17/02

[52] U.S. Cl. ..... 401/48; 401/137

[58] Field of Search ..... 401/48, 137–139

[56] References Cited

U.S. PATENT DOCUMENTS

| | | | |
|---|---|---|---|
| 2,877,476 | 3/1959 | Kaszewski | 401/48 X |
| 3,087,188 | 4/1963 | Garlock | 401/48 |

*Primary Examiner*—Stephen C. Pellegrino

*Attorney, Agent, or Firm*—Trask & Britt

[57] ABSTRACT

A machine for the pouring and spreading of hot asphalt in an even and uniform manner on roof tops, the asphalt spreading machine consisting of an insulated chamber for containing hot asphalt, a piping system with port holes for regulating the flow of hot asphalt from the container on to the roof top, a pit-cock valve and valve control handle for turning on or shutting off the flow of asphalt from the container, an air vent tube to permit draining of the hot asphalt from the system when the machine is turned off, a detachable handle for pulling the machine along the roof top, and a detachable rake and spreading screens for uniformly spreading the asphalt on the roof top, with the detachable features of the machine allowing for storage of the machine in small spaces and also facilitating lifting the machine to the top of a roof.

4 Claims, 4 Drawing Figures

ASPHALT SPREADING MACHINE

BACKGROUND OF THE INVENTION

1. Field of the Invention

This invention relates to a hot asphalt spreading machine for the pouring and spreading of hot asphalt in an even and uniform manner on to a roof surface.

2. Description of the Prior Art

The application of hot asphalt to roof tops has always been a time consuming and tedious chore, with the hot asphalt being normally spread unevenly on roof tops to thereby cause an excessive waste of time and materials. At the present time, hot asphalt is normally dumped on the top of the roof in a predetermined location and then must be spread by means of hand rakes or mops so that, in order to assure a minimum thickness completely covering the roof top, it is virtually impossible to avoid the application of too much asphalt with the asphalt being applied in non-consistent thickness.

SUMMARY OF THE INVENTION

The present invention provides a novel asphalt spreading machine for the pouring and spreading of hot asphalt on to a roof surface with a uniform amount of asphalt being dispensed from the machine which is then spread and raked evenly over the roof surface in a rapid and efficient manner, thus minimizing time and labor and the use of materials.

It is a feature of the present invention to provide an asphalt spreading machine.

A further feature of the present invention provides an asphalt spreading machine which is easy to use and reliable and efficient in operation.

Yet still a further feature of the present invention provides an asphalt spreading machine which is of a rugged and durable construction and which, therefore, may be guaranteed by the manufacturer to withstand rough and continual usage.

Other features of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
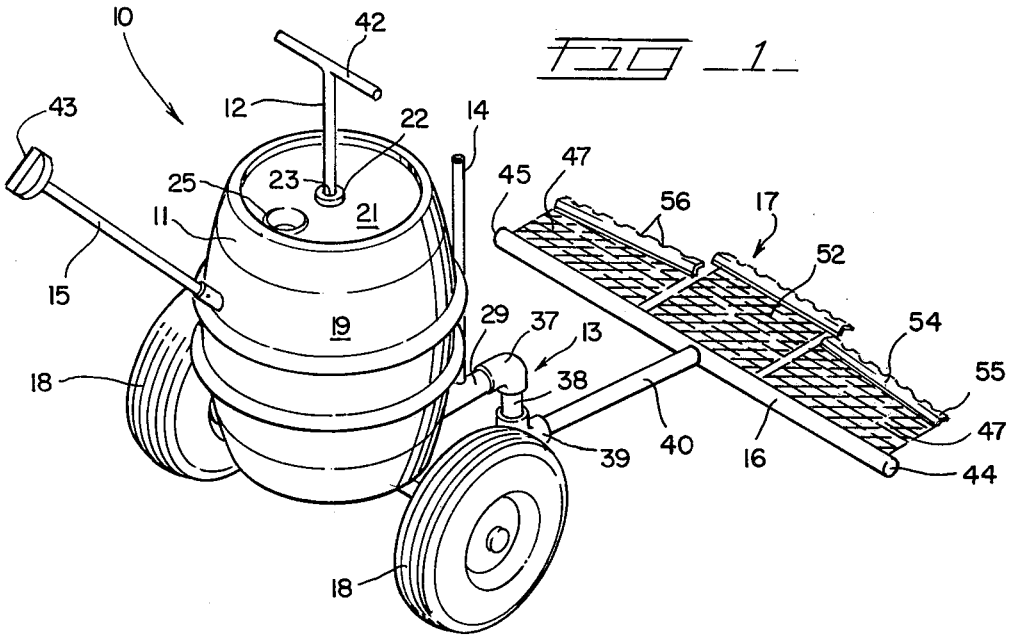
FIG. 1 is a perspective view of the asphalt spreading machine.
Figure 2:
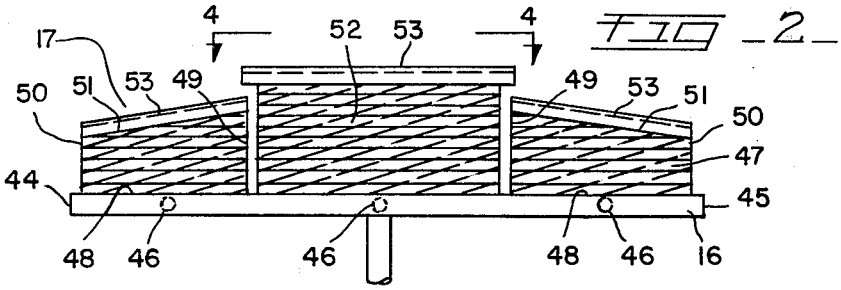
FIG. 2 is a bottom view of the asphalt pouring and spreading attachment.
Figure 3:
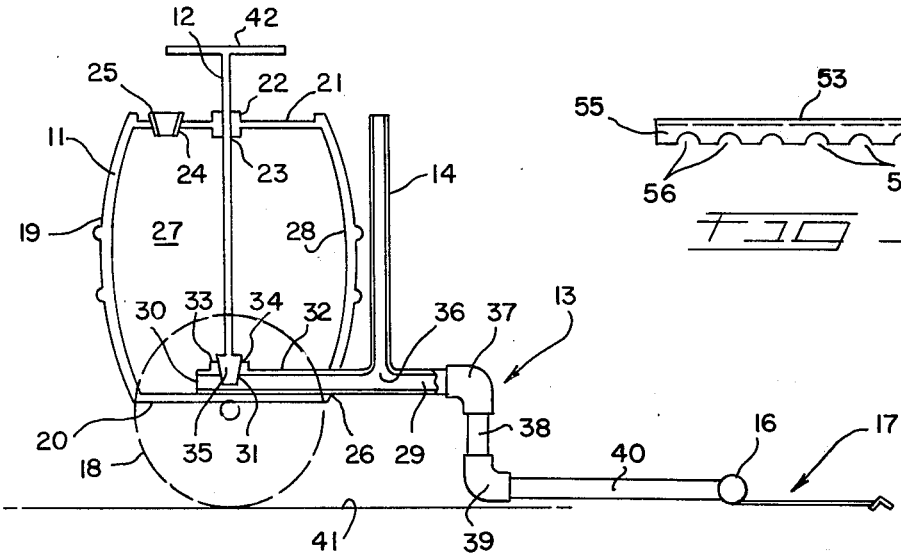
FIG. 3 is a side cut-away view of the asphalt spreading machine to show the internal workings of the asphalt container.
Figure 4:
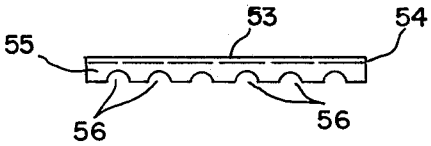
FIG. 4 is a sectional side view of the asphalt rake mechanism.

Referring now to the drawings in detail, there is illustrated a preferred form of the asphalt spreading machine constructed in accordance with the principles of the present invention and which is designated generally in its entirety by the reference numeral 10 and which is comprised of an insulated container 11, a valve handle 12, asphalt feed pipes 13, with air vent tube 14, a detachable handle 15, an asphalt pouring pipe 16, an asphalt spreading screens and rakes assembly 17, a set of wheels

18, and associated fittings and tubing interconnecting the components as will be later described.

The insulated container 11 consists of a barrel-shaped cylindrical side wall surface 19 with a completely enclosed bottom surface 20 with the top surface 21 being reinforced at the center thereof with the round flange 22 which is provided in its center with the round through-hole 23 for assembly of the valve handle 12 therethrough and with the round hole 24 being provided toward one end of the top surface 21 for assembly of the funnel 25 therethrough in a rigid manner, such as by welding, and with the cylindrical side wall surface 19 also being provided with the round through-hole 26 at the bottom of the container 11 for assembly of the asphalt feed pipes 13 into the interior compartment 27 which is completely lined with heat resistant insulating material 28, such as asbestos.

The asphalt feed pipes 13 are constructed of a series of metal pipes and elbows, consisting of a length of round pipe 29 having an end surface 30 open and positioned within the interior compartment 27 of the container 11 with a round through-hole 31 provided in the top surface 32 of the pipe 29 to which is rigidly affixed, such as by welding, a round flange 33 which is provided with a centered and conically shaped through-hole 34 for assembly of the pit-cock valve 35 therethrough, the pipe 29 also being provided with a through-hole 36 through its top surface 32 on the outside of the container 11 for assembly of the air vent tube 14 thereto and with the opposite end surface of the pipe 19 (not shown) being threadably attached to one end of the 90 degree elbow 37. The 90 degree elbow 37 is threadably attached to the end of pipe 29 so as to be turned in a downward position with a short length of pipe 38 being threadably attached to its opposite end and interconnecting a 90 degree elbow 37 with the 90 degree elbow 39, with a length of pipe 40 being threadably attached to the opposite end of the 90 degree elbow 39 so that the pipe 40 is provided close to and parallel with the roof surface 41.

The valve handle 12 consists of a round rod made of durable material, such as steel, with its top portion protruding outside and above the container 11 and to which is securely affixed, such as by welding, a T-shaped handle 42 with the bottom portion of the valve handle 12 being placed inside the interior compartment 27 of the container 11 and with the pit-cock valve 35 being securely affixed, such as by welding, to the end of the handle within the interior compartment 27; along the length of the handle extending through the through-hole 23 of the round flange 22 are provided threads (not shown) for engagement of threads (not shown) provided in the through-hole 23 so that turning of the T-shaped handle 42 will raise or lower the valve handle 12 and the pit-cock valve 35 in the round through-hole 31 of the pipe 29.

The detachable handle 15 consists of a length of round rod, such as steel, and is provided on one end with conventional type handle 43 with the other end of the handle 15 detachably affixed to outside of the container 11 in any conventional way.

The asphalt spreading screens and rakes assembly 17 is affixed, such as by welding, to the asphalt pouring pipe 16 which, in turn, consists of a length of pipe being closed at its end surfaces 44 and 45 and provided on its bottom surface with a series of through round holes 46 and being threadably attached (threading arrangement not shown) at its center to pipe 40; the asphalt spreading screens and rakes assembly 17 consisting of two screens 47 constructed of heavy-duty chain-like webbing and formed with a leading edge 48 which is rigidly affixed to the trailing edge of the asphalt pouring pipe 16, of the interior side edges 49 which are longer in dimension than the exterior side edges 50 so as to provide a sloped trailing edge 51. The center screen 52 is rectangular in shape and is provided along the center of the length of the asphalt pouring pipe 16 in between the screens 47. A length of raking bracket 53 is securely attached, such as by welding, to the trailing edges of the screens 47 and 52 with the length of the raking bracket 53 cut to exact length to match the sloping edges 51 of the screens 47 and the length of raking bracket 53 provided along the trailing edge of the screen 52 is longer in length than the trailing edge of the screen 52 so as to overlap the interior side edges 49 of the screens 47. The raking bracket 53 is constructed from a length of right angle material with an unnotched side 54 being securely affixed to the trailing edges of the screens 47 and 52 and with the notched side 55 being formed with a series of notches 56 along its length.

In operation, the detachable handle 15 is removed from the container 11 and the asphalt spreading screens and rakes assembly 17 is disassembled from the asphalt spreading machine 10 by unthreading pipe 40 from the 90 degree elbow 39 for purposes of storing the machine and for hauling it to the top of the roof surface 41. The detachable handle 15 and asphalt spreading screens and rakes assembly 17 is replaced on the asphalt spreading machine 10 when in position and ready for use on top of the roof surface 41, this being accomplished in the reversed procedure than when the machine is disassembled. Hot asphalt is poured inside the interior compartment 27 through funnel 25 with the pit-cock valve 35 in a closed position and, since the interior components of the container are constructed of highly heat conducting material, any asphalt that has set up from prior use inside the machine will readily melt and begin to flow. The asphalt spreading machine 10 is then pushed or pulled easily on the wheels 18 to the desired location on the roof top. The valve handle 12 is then turned to open the pip-cock valve 35 to allow the hot asphalt from the interior compartment 27 to flow through the end surface 30 into the pipe 29, through the 90 degree elbow 37, the pipe 38, the 90 degree elbow 39, the pipe 40, and into the asphalt pouring pipe 16 and out of the bottom holes 46 on to the top of the roof 41. The user then pulls the asphalt spreading machine 10 uniformly across the roof surface 41 by pulling the handle 43, the screens 47 and 52 then compressing the hot asphalt on to the roof surface 41, followed by the raking of the asphalt in a uniform and even amount over the roof surface 41 by means of the notches 56. The notches 56 will form uniform and evenly spaced ridges in the applied asphalt that will flow together after the rake has gone past to assure even distribution of asphalt along the roof surface 41. When use of the asphalt spreading machine 10 is discontinued, the valve handle 12 is turned to close the pip-clock valve 35 to shut off the flow of hot asphalt from the interior compartment 27 with the air vent tube 14 allowing for air pressure within the asphalt feed pipes 13 to allow the residue of heated asphalt therein to freely flow through the system and out of the round holes 46.

It is to be understood that the form of this invention as shown and described is to be taken as preferred example thereof, and that this invention is not to be limited to the exact arrangement of parts described in the description or illustrated in the drawings as changes thereto in the details thereof pertainin to size, shape and arrangement of parts thereof are envisioned within the scope of the invention without departing from the novel concepts of the invention.

Having thus described the invention, what is claimed is:

1. An asphalt spreading machine for the pouring and spreading of hot asphalt in an even and uniform manner on roof surfaces, the machine comprising, in combination, an insulated cylindrical container securely mounted to an axle journaled in and supported by a pair of wheels, said container having two holes in the top end and one hole in the side near the bottom end, a funnel shaped aperture in one of the holes on the top end, a threaded flange in the other hole which is centered on the top end, a T-shaped handle which is threadably engaged to the flange on the top surface of the container and which is further provided on its bottom end with a pit-cock valve, a detachable handle for manually moving the asphalt spreading machine, a series of pipes and elbows extending outwardly of the container to permit the hot asphalt to pour through the system of pipes outwardly of the container, an air vent pipe affixed to the asphalt piping system to permit free flow of hot asphalt out of the pipes when the machine is turned off, a length of pipe with port holes on the bottom to permit hot asphalt to pour therethrough on to the roof surface, and a series of detachable screens and rakes for uniformly spreading the hot asphalt poured on the roof surface.

2. The asphalt spreading machine as set forth in claim 1 wherein the handle is detachable as is the rake assembly for ease of storing the machine in small spaces when not in use and for ease in hauling the machine on to a roof surface.

3. The machine as set forth in claim 1 wherein the screens used to spread the asphalt over the roof surface are constructed of durable chain like webbing with three sections of screen securely affixed to the trailing edge of the asphalt pouring pipe, and with lengths of angle iron type material securely attached to the trailing edges of the screens and with one edge of the angle material being provided with a series of notches along its length to provide a raking action of the poured hot asphalt, thereby causing uniform and evenly spaced ridges in the hot asphalt which flow together to provide a consistant application of asphalt on the roof surface.

4. The machine as set forth in claim 1 wherein hot asphalt flows from the interior of the asphalt container through a gravity flow piping system consisting of a length of pipe which is securely affixed at the bottom interior of the container and extending outwardly from the container with the end of the pipe inside the container left open and with the end of the pipe outside the container threadably attached to a 90 degree elbow with the opposite end of the elbow turned in a downward position, an interconnecting length of pipe between said elbow to a second 90 degree elbow with the opposite end of the second elbow being threadably attached to a third length of pipe which rides parallel to the roof surface and with its opposite end being securely attached to the center of and perpendicularly to a length of pipe with port holes on its bottom surface for permitting free flow of the asphalt therethrough on to the roof surface.

* * * * *